US006622595B1

(12) United States Patent
Federighi

(10) Patent No.: US 6,622,595 B1
(45) Date of Patent: Sep. 23, 2003

(54) CORK EXTRACTOR TOOL

(76) Inventor: William Federighi, 7 Commercial Blvd., Novato, CA (US) 94945

( * ) Notice: Subject to any disclaimer, the term of this patent is extended or adjusted under 35 U.S.C. 154(b) by 0 days.

(21) Appl. No.: 10/212,286

(22) Filed: Aug. 1, 2002

(51) Int. Cl.[7] ..... B67B 7/04

(52) U.S. Cl. ..... 81/3.48; 81/3.2; 81/3.29; 7/155

(58) Field of Search ..... 81/3.2, 3.36, 3.29, 81/3.47, 3.48; 7/155, 156

(56) References Cited

U.S. PATENT DOCUMENTS

| | | | | | |
|---|---|---|---|---|---|
| 35,514 | A | * | 6/1862 | Fradgley | 81/3.29 |
| 3,085,454 | A | * | 4/1963 | Federighi | 81/3.2 |
| 3,192,803 | A | * | 7/1965 | Federighi | 81/3.2 |
| 4,791,834 | A | * | 12/1988 | Federighi | 81/3.2 |
| 4,800,784 | A | * | 1/1989 | Allen | 81/3.36 |
| 5,005,446 | A | * | 4/1991 | Mackey | 81/3.48 |
| 5,012,703 | A | * | 5/1991 | Reinbacher | 81/3.29 |
| 5,020,395 | A | * | 6/1991 | Mackey | 81/3.2 |
| 6,196,086 | B1 | * | 3/2001 | Gort-Barten | 7/155 |
| 2002/0083797 | A1 | * | 7/2002 | Federighi | 81/3.2 |

* cited by examiner

*Primary Examiner*—James G. Smith
(74) *Attorney, Agent, or Firm*—Harris Zimmerman

(57) ABSTRACT

A cork extractor tool for removing the cork from wine bottles has a cylindrical needle carrier with an attached axially directed hollow needle of sufficient length to penetrate through the cork. The needle carrier is slidably disposed within a tubular sleeve which closely fits within a handle. The handle and tubular sleeve are arranged to rotate the needle carrier and needle using a pair of helical grooves disposed through the tubular sleeve, with a pair of corresponding roller guides which extend radially inwardly from the handle through the respective helical groove and which are affixed to the needle carrier. A pair of radially oppositely disposed graspable positioning legs include lower arcuate bottle gripping portions which engage the bottle to facilitate placement of the cork extractor tool on the bottle. As the handle is axially forced downwardly from a raised position along the tubular sleeve to a lower position thereon, the needle penetrates the cork in an axially rotating fashion to facilitate easy cork penetration. Pressurized fluid is then injected into the bottle from a replaceable container of the pressurized fluid having an integral metering valve. The metering valve introduces a controlled volume of the pressurized fluid through the needle into the bottle to smoothly eject the cork from the bottle. Removed corks are easily stripped from the needle by a cork stripping portion of the tubular sleeve through which the needle extends and retracts during use by reversing the motion to return the handle to the raised position. Optional cutting blades on the positioning legs facilitate cutting of foil wrapping at the top of bottle prior to cork removal.

25 Claims, 5 Drawing Sheets

CORK EXTRACTOR TOOL

BACKGROUND OF THE INVENTION

1. Field

Figure 1:
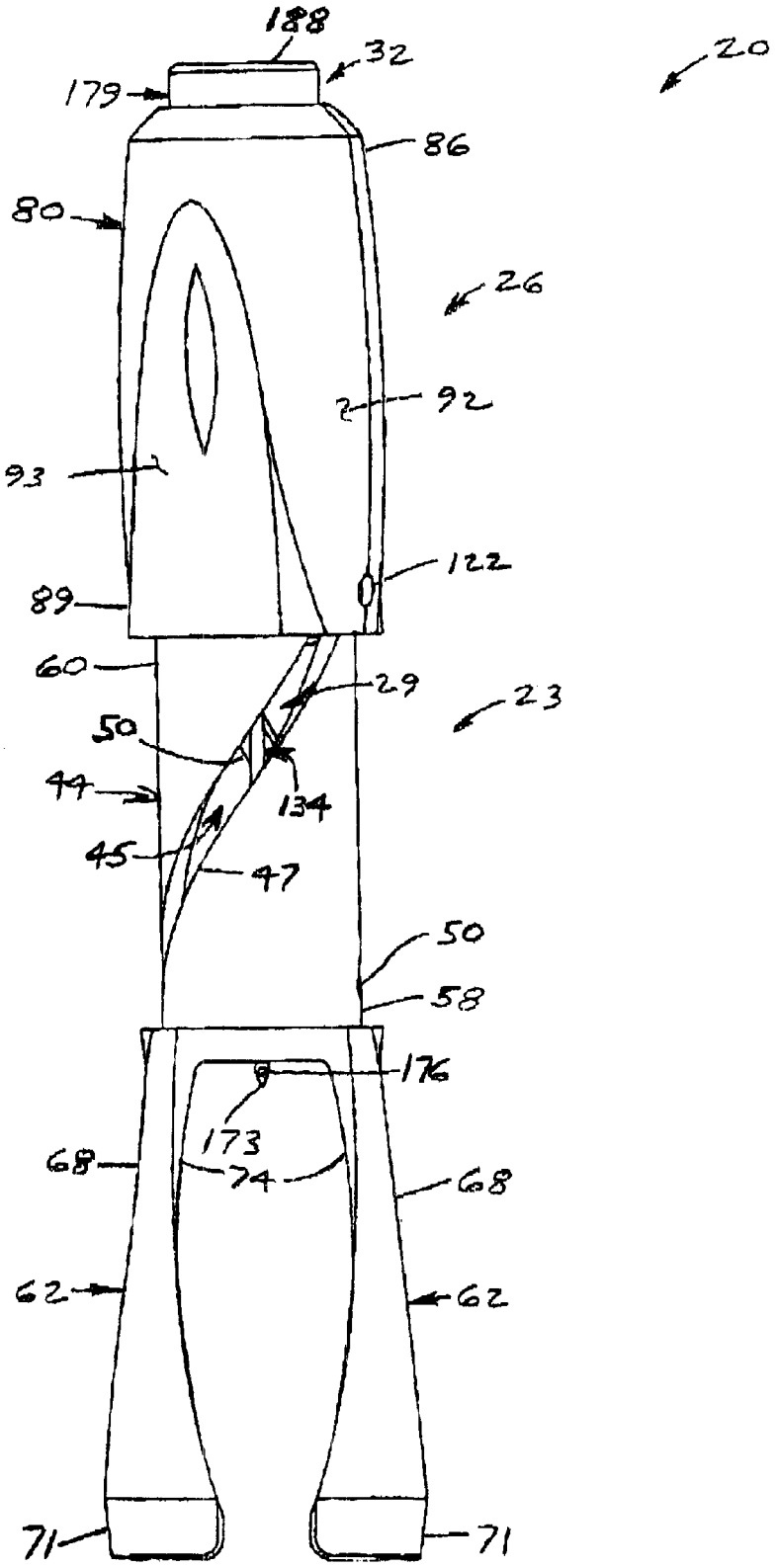

The present invention relates to devices for facilitating the withdrawal of corks and similar stoppers from bottles, and more particularly to those devices which inject pressurized gas into the bottle through the cork to facilitate removal of the cork.

2. State of the Art

Bottle which contain wine, and some other types of liquid beverages in bottles, are traditionally closed and sealed by a cork which is friction fitted into a neck of the bottle. Use of conventional corkscrews for extraction of the cork from the bottle prior to drinking is subject to problems such as incomplete removal of the cork and cork chips falling into the bottle. Likewise, substantial physical effort and dexterity are required on the part of the user of the corkscrew to remove the cork.

In an effort to simplify the opening of corked bottles, cork extractor tools were developed of a type which injects pressurized fluid such as compressed air or carbon dioxide gas into the bottle through a needle which penetrates through the cork. Expansion of the pressurized fluid ejects the cork from the bottle. While this type of cork extractor tool may reduce some of the cork chipping problems, significant physical effort is still required by the user to force the needle through the cork. Likewise, subsequently physical effort is required to pull the extracted cork from the needle. The presence of an exposed sharp needle requires that the device be carefully handled and manipulated so as to avoid injury to the user and other persons.

Bottle stoppers formed of synthetic materials such as plastics having physical properties similar to those of natural cork are sometimes used in place of corks (such synthetic bottle stoppers as well as bottle stoppers made of natural cork material herein referred to as corks unless stated otherwise). Penetrating these synthetic bottle stoppers with the needle may require more effort than penetration of natural cork bottle stoppers. Bottle stoppers formed of synthetic materials may also exhibit more frictional resistance to removal of the bottle stopper from the needle.

Wine bottles and some other bottles such as those which contain sparkling grape juice are often capped with a wrapping of metal foil or another similar material which is adhered to the neck of the bottle. The foil wrapping must be ruptured or removed to enable withdrawal of the cork from the bottle. The end of the cork screw and particularly the pointed needle of the pressurized gas cork extractor are not a very effective tool for this purpose.

There is a need for an improved cork extractor tool which is easy to use, requiring significantly less physical force to extract the cork from the bottle and to strip the extracted cork from the cork extractor tool.

SUMMARY OF THE INVENTION

The present invention is a cork extractor tool for withdrawing a cork from the neck of a bottle. A first version of the cork extractor tool utilizes a replaceable pressurized container of the type having a generally cylindrical fluid container which contains a pressurized fluid having a boiling point below room temperature so as to expand upon depressurization. A valve covers an opening in an end portion of the fluid container with an outlet tube which opens the valve when depressed to release pressurized fluid from the pressurized container through the outlet tube. The present invention is also a combination of the first version cork extractor tool described below with the replaceable pressurized container of the type described above.

The first version cork extractor tool includes a tubular sleeve having an annular outer wall adapted to receive at least the end portion of the fluid container therewithin, with a positioning portion which extends from a bottom end of the tubular sleeve adapted for grasping in-hand and coaxially engaging the neck of the bottle above the cork. The pressurized container is longitudinally movable within the tubular sleeve to actuate the valve to release pressurized fluid therefrom. A handle is coaxially disposed about the tubular sleeve, the handle having a longitudinal bore which extends completely through the handle in which the tubular sleeve is closely slidably disposed. A needle carrier is slidably disposed within the tubular sleeve which is operatively connected to the handle for axial and rotational movement therewith within the tubular sleeve. The needle carrier has a longitudinal bore therethrough adapted to receive pressurized fluid from the outlet tube of the pressurized container. A hollow needle extends axially from the needle carrier adapted for axial and rotational movement with the needle carrier, the needle being of sufficient length to penetrate axially through the cork and having a longitudinal passage for transporting the pressurized fluid therethrough. The needle is operatively connected to the needle carrier to receive pressurized fluid therefrom and pass the pressurized fluid through into the bottle. A rotation device operatively interconnects the tubular sleeve and the handle, being adapted to produce relative rotational motion therebetween upon axial translation thereof. When the positioning portion of the tubular sleeve coaxially engages the neck of the bottle above the cork and the handle is forced downwardly toward the cork, the needle is axially driven through the cork with an axial rotation to facilitate penetration. When the pressurized container is subsequently depressed to inject the pressurized fluid into the bottle through the needle, a resulting rise in pressure within the bottle as the pressurized fluid expands to a gas acts to eject the cork from the bottle.

A second version cork extractor tool utilizes a replaceable pressurized container of the type having a generally cylindrical fluid container which contains a pressurized fluid having a boiling point below room temperature so as to expand upon depressurization, and an initially sealed opening in an end portion of the fluid container.

The second version cork extractor tool includes a valve that is operatively associated with the initially sealed opening. The valve is adapted to sealingly receive the end portion of the fluid container and open the initially sealed opening for fluid flow to the valve. The valve opens when depressed to release pressurized fluid from the pressurized container. A tubular sleeve having an annular outer wall is adapted to receive at least the end portion of the fluid container therewithin. The tubular sleeve has a positioning portion extending from a bottom end of the tubular sleeve adapted for grasping in-hand and coaxially engaging the neck of the bottle above the cork. The pressurized container is longitudinally movable within the tubular sleeve to actuate the valve to release pressurized fluid therefrom. A handle is coaxially disposed about the tubular sleeve. The handle has a longitudinal bore that extends completely through the handle in which the tubular sleeve is closely slidably disposed. A needle carrier is slidably disposed within the tubular sleeve, which needle carrier is operatively connected to the handle for axial and rotational movement therewith within the tubular sleeve. The needle carrier has a longitudinal bore therethrough adapted to receive pressurized fluid from the valve. A hollow needle extends axially from the needle carrier and is adapted for axial and rotational movement with the needle carrier. The needle is of sufficient length to penetrate axially through the cork and has a longitudinal passage for transporting the pressurized fluid therethrough. The needle is operatively connected to the needle carrier to receive pressurized fluid therefrom and pass the pressurized fluid through into the bottle. A rotation device operatively interconnects the tubular sleeve and the handle. The rotation device is adapted to produce relative rotational motion between the tubular sleeve and the handle upon axial translation therebetween. When the positioning portion of the tubular sleeve coaxially engages the neck of the bottle above the cork and the handle is forced downwardly toward the cork, the needle is axially driven through the cork with an axial rotation to facilitate penetration. When the pressurized container is subsequently depressed to inject the pressurized fluid into the bottle through the needle, a resulting rise in pressure within the bottle as the pressurized fluid expands to a gas acts to eject the cork from the bottle.

THE DRAWINGS

Figure 2:
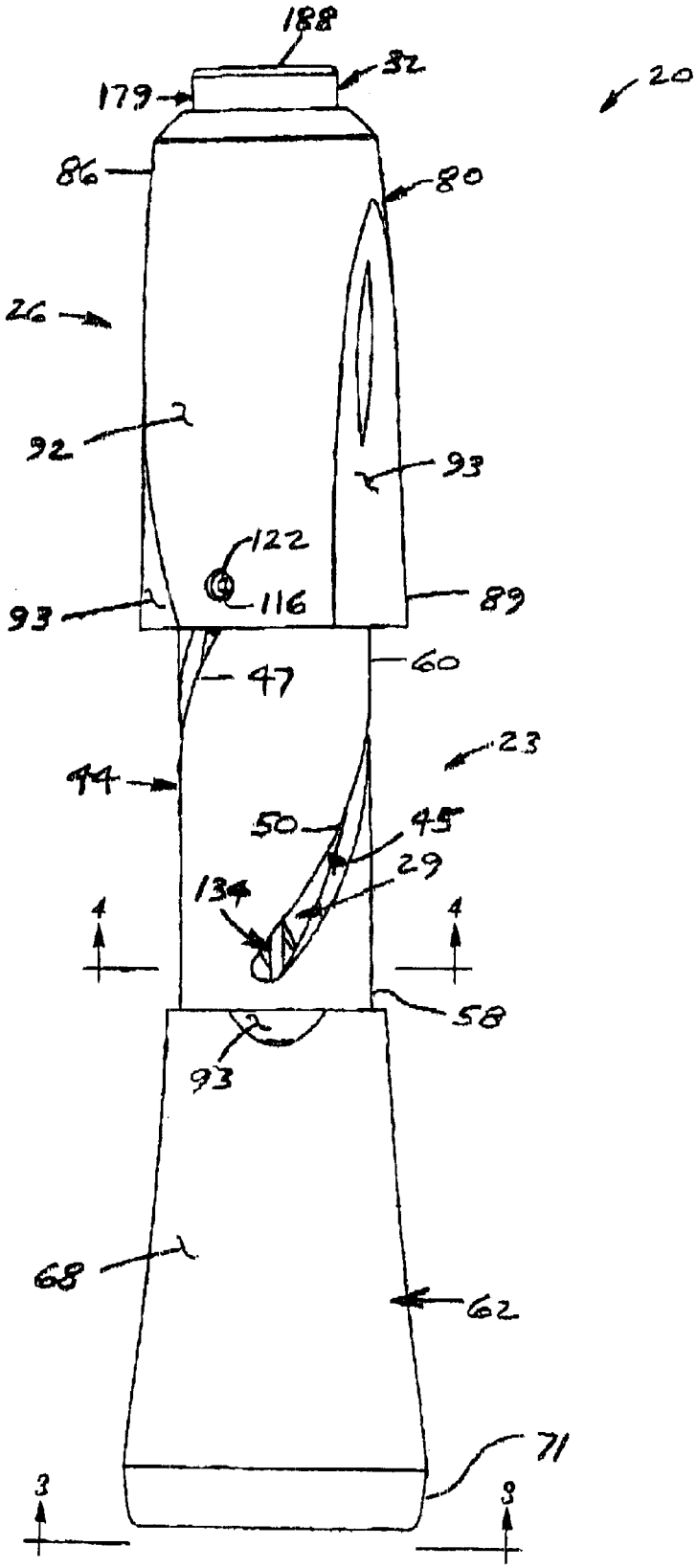
Figure 3:
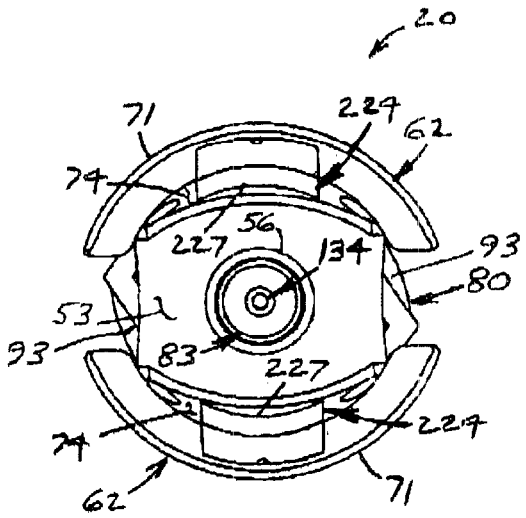
Figure 4:
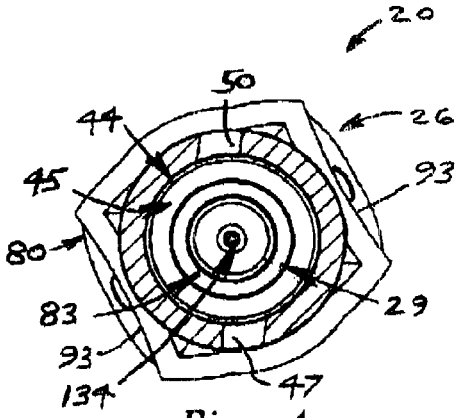
Figure 6:
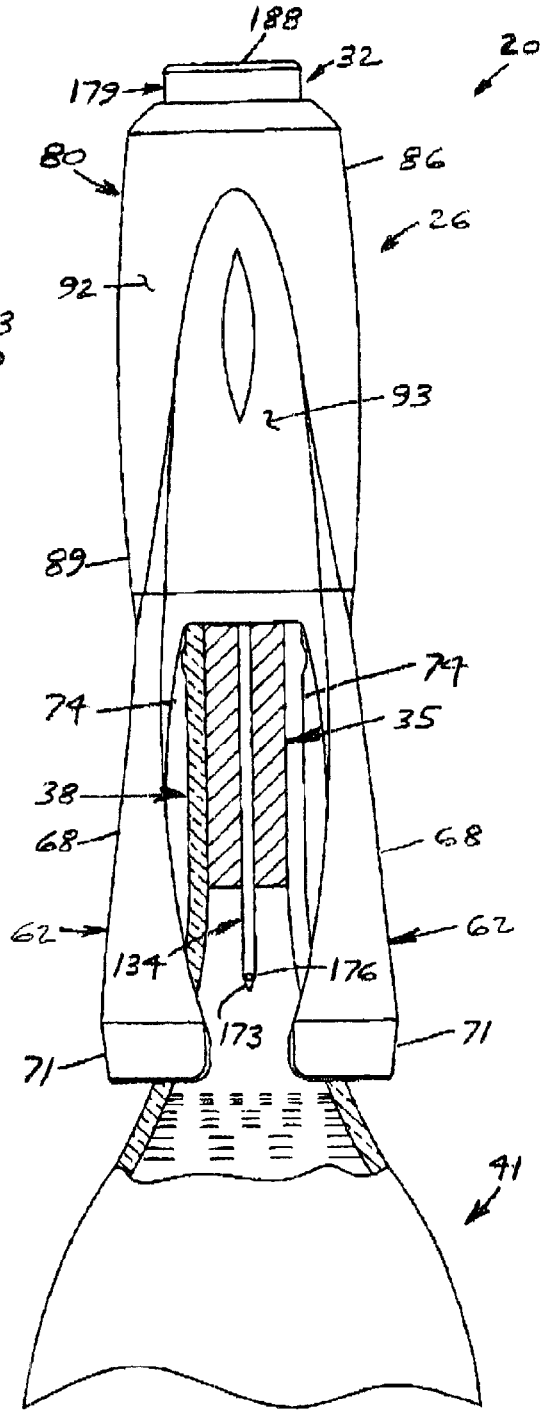
Figure 5:
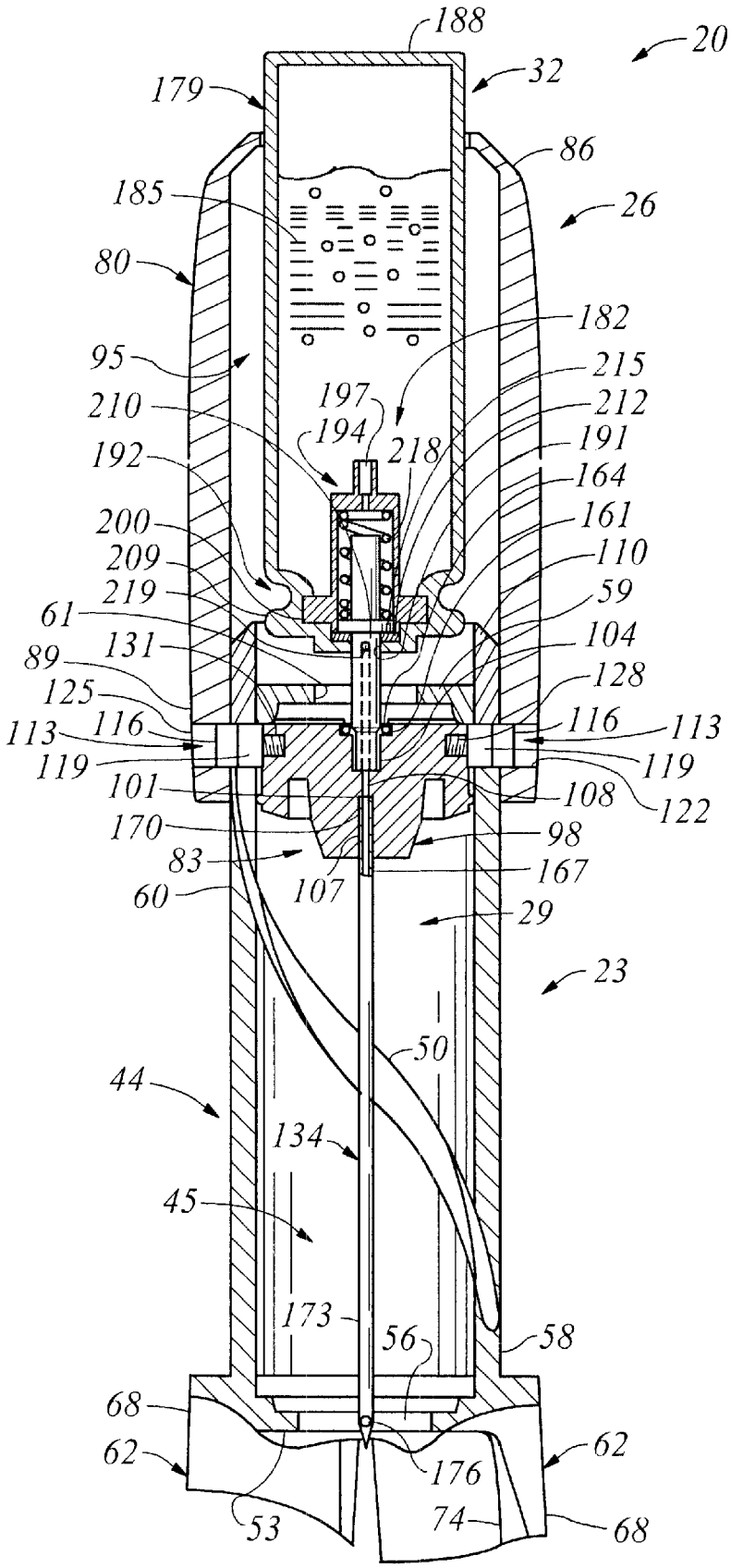
Figure 7:
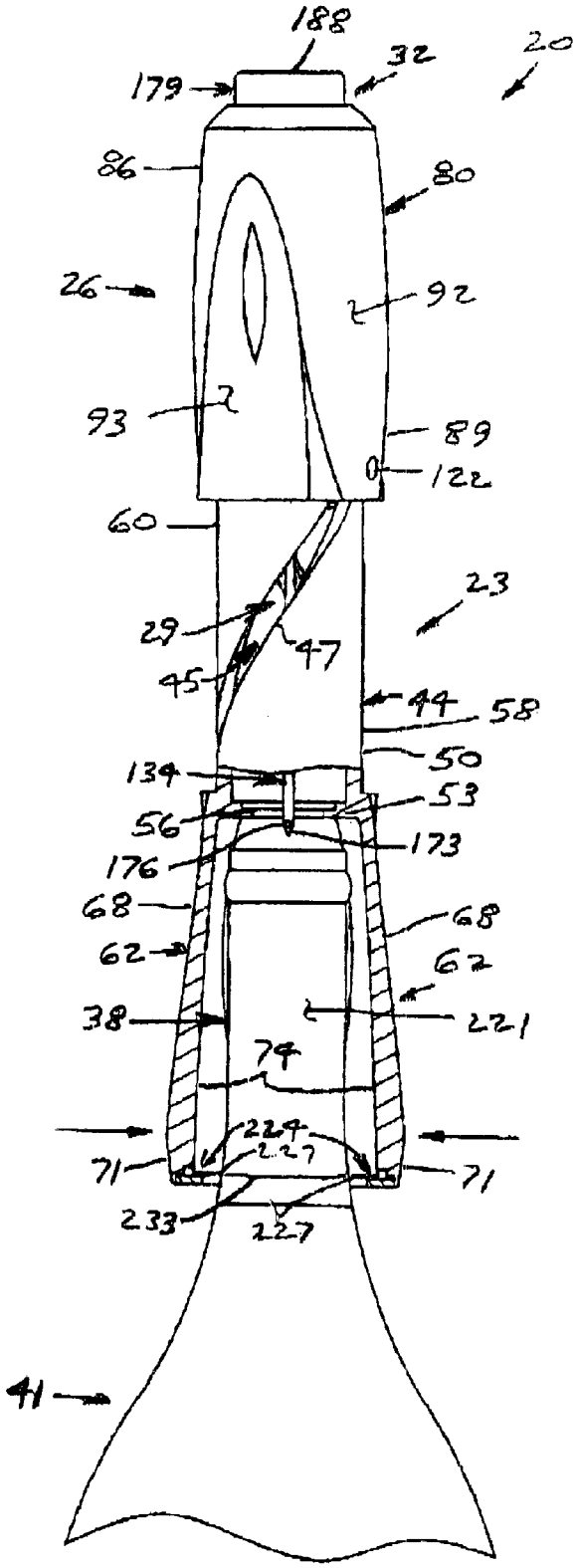
Figure 8:
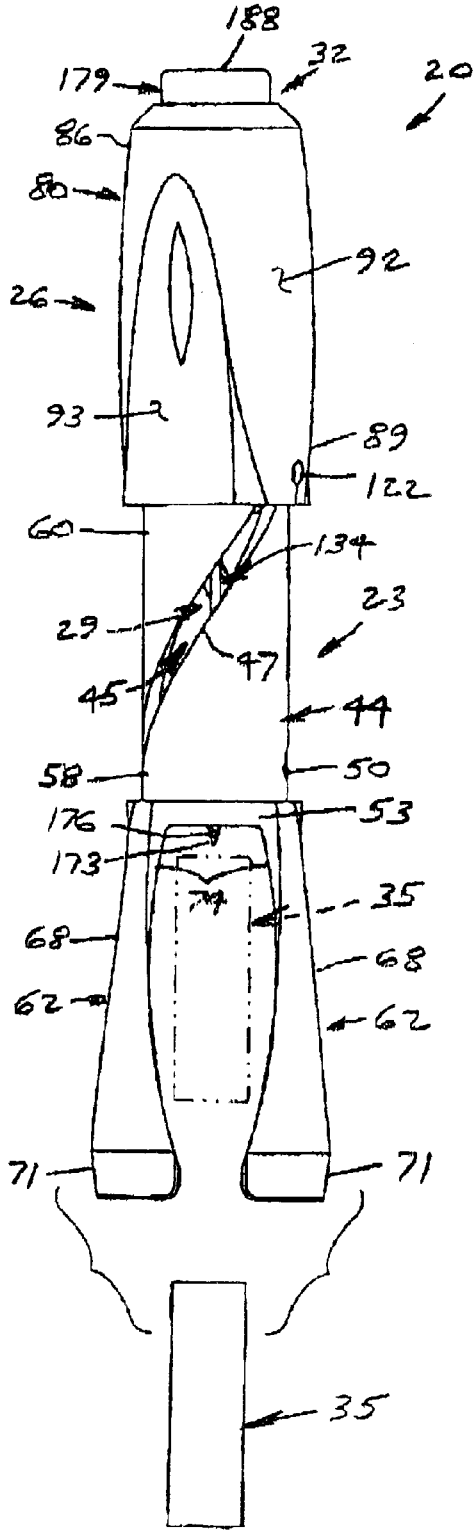

The best mode presently contemplated for carrying out the invention is illustrated in the accompanying drawings, in which:

FIG. 1 is a front elevational view of a cork extractor tool in accordance with the present invention;

FIG. 2, a side elevational view of the cork extractor tool;

FIG. 3, a bottom plan view of the cork extractor tool taken on the 3—3 of FIG. 2;

FIG. 4, a lateral horizontal sectional view of the cork extractor tool taken on the line 4—4 of FIG. 2;

FIG. 5, a partial longitudinal vertical sectional view of the cork extractor tool;

FIG. 6, a fragmentary front elevational view of the cork extractor tool as used to remove a cork from the neck of a wine bottle, the neck and cork being broken out in partial longitudinal cross-section;

FIG. 7, a front elevational view of the cork extractor tool in partial longitudinal cross-section and the wine bottle showing a foil wrapping over the cork and part of the neck, showing use of the cork extractor tool for cutting away the top of the foil wrapping prior to removal of the cork; and FIG. 8, a front elevational view of the cork extractor tool ejecting the cork from the needle following withdrawal of the cork from the bottle.

DETAILED DESCRIPTION OF THE ILLUSTRATED EMBODIMENTS

Referring to FIGS. 1–8, therein is shown an exemplary cork extractor tool according to the present invention, generally designated at 20, comprising a cylindrical sleeve assembly 23, a movable handle assembly 26, and a needle assembly 29. The cork extractor tool 20 utilizes pressurized containers 32 to extract a cork 35 from the tubular neck 38 of a bottle 41.

The cylindrical sleeve assembly 23 includes a tubular sleeve 44 having a longitudinal bore 45 and a pair of intertwined helical slots 47 and 50. A cork removal portion 53 having a needle passing hole 56 of a smaller diameter than cork 35 covers a lower end 58 of the tubular sleeve 44. This enables abutment of the cork removal portion 53 against the neck 38 of bottle 41 and the cork 35. A pair of positioning legs 62 oppositely disposed on lower end 58 of tubular sleeve 44 each have an elongate support bar portion 68 with arcuate bottle gripping portion 71. The support portions 68 are of a contoured configuration, each including a curved inner surface 74 which is longitudinally concave to provide additional clearance with the bottle 41. A flange 59 extends radially inwardly from an upper end 60 of tubular sleeve 44 forming a pressurized container engagement hole 61. The tubular sleeve 44 and positioning legs 62 are preferably integrally injection molded from plastic. Likewise, needle carrier 98 and tapered sleeve 110 are preferably separately injection molded from plastic.

The handle assembly 26 includes a gripping handle 80 and a needle carrier assembly 83. The handle 80 includes respective upper and lower portions 86 and 89 interconnected by a contoured outer surface 92. A pair of longitudinal depressions 93 are disposed in outer surface 92 to aid in gripping handle assembly 26 in-hand. A longitudinal bore 95 extends through handle 80 which is closely slidably disposed about the tubular sleeve 44. The bore 95 is of sufficient size to receive the pressurized containers 32 at the upper portion 86. The needle carrier assembly 83 includes a needle carrier 98 of such an outer diameter as to closely slidably fit within the tubular sleeve 44, being connected to the lower portion 89 through the respective helical slots 47 and 50 of the tubular sleeve 44. The needle carrier 98 includes a central bore 101 therethrough having a tube receiving upper portion 104 and a needle receiving lower portion 107. A tapered sleeve 110 is affixed above needle carrier 98 within bore 95 of handle 80 such as by using adhesives or pressfitting. The needle carrier assembly 83 further includes a pair of roller assemblies 113 each comprising a socket head screw 116 and a tubular bushing 119 that retain the needle carrier 98 to handle 80. The screws 116 and bushings 119 are disposed in respective clearance holes 122 and 125 through lower portion 89, through the respective helical slots 47 and 50 of tubular sleeve 44, and thread into respective threaded holes 128 and 131 of needle carrier 98. The screws 116 may be tightened securely against the bushings 119 or slightly backed off from tight such that bushings 119 may rotate thereon as rollers. In the latter case, the screws 116 are secured within the threaded holes 128 and 131 using a commercially available locking liquid or adhesive. The needle carrier 98 is disposed in coaxial relationship with the handle 80 and the tubular sleeve 44. As the handle assembly 26 is linearly moved relative to sleeve assembly 23, relative rotation therebetween is created as bushings 119 follow the respective helical slots 47 and 50. Upward and downward travel of the handle assembly 26 on the sleeve assembly 23 is limited by the bushings 119 in the respective helical slots 47 and 50 of tubular sleeve 44.

The needle assembly 29 includes a hollow needle 134 which is directly affixed within lower portion 107 of central bore 101. Alternatively, needle assembly 29 may include a needle fitting (not shown) into which needle 134 is affixed, which fitting threadably engages a matingly threaded bore of needle carrier 98. An annular O-ring groove 161 is formed in needle carrier 98 about central bore 101 for receiving an O-ring 164. The needle 134 includes a blunt upper portion 167 with an inlet hole 170 and a pointed lower portion 173 with a transverse outlet hole 176 therethrough. The upper portion 167 is pressfit into the lower portion 107 of bore 101 and extends downwardly with the lower portion extending through the hole 56 of the cork removal portion 53. Needle 134 is of sufficient length to enable complete penetration of the needle longitudinally centered through the cork 35.

As best shown in FIG. 5, the pressurized containers 32 comprise a cylindrical fluid container 179 and a valve 182.

Container 179 contains a pressurized fluid 185, the fluid being in the form of a liquid, a gas, or a combination thereof (herein referred to as fluid as relates to the present invention), such as a volatile fluid comprising liquefied chlorofluorocarbon gas such as sold under the trade name Freon™, having a boiling point below room temperature, which is injected into the bottle 41 through needle 134 with the resulting rise in pressure within the bottle 41 acting to eject the cork 35. Alternately, the pressurized fluid 185 may be a common pressurized gas such as compressed carbon dioxide which may or may not be in the form of a liquid. The fluid container 179 fits within the bore 95 of handle 80, through tapered sleeve 110, and hole 61 of tubular sleeve 44, extending in coaxial relationship therewith. An upper end 188 of container 179 protrudes for a short distance upwardly beyond the upper portion 86 of handle 80 to facilitate downward actuation of container 179 by hand. The valve 182 is disposed covering an opening 191 in a tapered end portion 192 of container 179.

Valve 182 is preferably of the metering type described in U.S. Pat. No. 4,791,834 issued to George Federighi, the disclosure of which is herein incorporated by reference, and of which type will be described below. The valve 182 releases a fixed volume of pressurized fluid 185 from container 179 in response to each downward movement of the container 179 regardless of the duration of the downward movement. The use of a metering type valve 182 helps to avoid over-pressurization of the bottle 41 which could cause an undesirably rapid ejection of the cork 35. The valve 182 includes a cylindrical housing 194 that is in coaxial relationship with container 179 and which has an upper fluid inlet 197. Housing 194 includes a flange 200 which is retained to container 179 in a gas-tight manner using an end cap 209 which is crimped around the flange 200 and the tapered end portion 192 of container 179. An outlet tube in the form of a tubular valve member 210 slidably extends into housing 194 through end cap 209, and through a resilient annular sealing gasket 212 of the valve 182. Valve member 210 includes a flange 215 that seats against sealing gasket 212, and a compression spring 218 disposed in housing 194 that extends between the flange 215 and housing 194 to exert a downward force on the valve member 210 to maintain a sealing relationship of flange 215 against sealing gasket 212. Downward movement of valve member 210 in response to urging by spring 218 is limited by abutting of end cap 209 and sealing gasket 212 against the flange 215. Thumb pressure on the protruding upper end 188 of container 179 forces the container 179 including end cap 209 and sealing gasket 212 downwardly relative to flange 215. This movement momentarily opens valve 182 by exposing an inlet hole 219 of valve member 210 inside of housing 194 thereby causing a release of a metered charge of pressurized fluid 185 through the valve member 210 and needle 134 into the bottle 41. The discharge of fluid 185 is limited to a fixed metered amount since the same movement causes valve member 210 to seat against and close the inlet 197 of housing 194.

The arcuate bottle gripping portions 71 of the positioning legs 62 are curved, with centers of curvature which are at needle 134, jointly partially encircle the neck 38 of bottle 41 when used (FIG. 6). The legs 62, while preferably molded integrally with tubular sleeve 44, may be machined from brass, molded from a plastic, or made of other material having sufficient resiliency to enable flexing of the legs 62 towards bottle 41 to bring the gripping portions 71 into contact with the bottle 41. A user of the cork extractor tool 20 may flex the legs 62 inward by squeezing together with the same hand that is grasping and supporting the cork extractor tool 20.

Referring to FIG. 7, many bottles 41 which contain wine, carbonated grape juice, or the like have a wrapping 221 of metal foil or other material which encircles the neck 38 of the bottle 41. The wrapping 221 typically extends over the neck 38 of the bottle 41 including the cork 35 and is adhered to the bottle 41. Cork extractor tool 20 may have a pair of cutting blades 224 to facilitate removal of the wrapping 221 over the cork 35 prior to extraction thereof. Cutting blades 224 extend radially inwardly a short distance inwardly from bottle gripping portions 71, being anchored thereto, and including arcuate cutting edges 227 (FIGS. 3 and 7). The bottle gripping portions 71 may be rested on the neck 38 of the bottle 41 with the cutting blades 224 engaging the wrapping 221 by flexing legs 62 inwardly in the manner previously described. Turning of the cork extractor tool 20 relative to bottle 41 makes a circular cut 233 through the wrapping 221 around the neck 38 of the bottle 41 which exposes the cork 35 for easy subsequent removal.

Again referring to FIG. 7, extraction of the cork 35 may be accomplished by turning handle assembly 26 relative to sleeve assembly 23 to a retracted position wherein needle 134 is nearly completely enclosed within tubular sleeve 44 with only the pointed lower portion 173 thereof extending through the needle passing hole 56 of cork removal portion 53. The cork extractor tool 20 is then positioned axially centered over the cork 35 and bottle 41, and the pointed lower portion 173 pressed downwardly into cork 35 until cork removal portion 53 prevents further downward movement. The handle assembly 26 may then be forced towards bottle 41 to simultaneously rotate and penetrate the needle 134 through the cork 35 to an extended position. The rotation of needle 35 during penetration greatly reduces the amount of downward force applied to handle assembly 26 necessary for complete axial penetration of the needle 134 through cork 35. The legs 62 including bottle gripping portions 71 establish and maintain proper alignment of the cork extractor tool 20 with the bottle 41 during this operation, and also shield the users hands from needle 134. Applying momentary thumb pressure on the upper end 188 of container 179 protruding upwardly from handle 80 causes a metered charge of pressurized fluid 185 to be released from container 179 through needle 134 and cork 35 into the bottle 41 as previously described to cause the smooth, non-violent ejection of the cork 35 from bottle 41. The ejection of cork 35 causes cork extractor tool 20 to rise therewith due to the contact of cork 35 with cork removal portion 53.

Referring to FIG. 8, another advantage of the cork extractor tool 20 is the easy removal of the ejected cork 35 from the needle 134 which operation can otherwise require considerable force. Removal of the cork 35 impaled on the needle 134 is accomplished by grasping sleeve assembly 23 in-hand and pulling handle assembly 26 back to the unextended position of needle 134, which gently rotates needle 134 from cork 35, being stripped therefrom by the needle 134 withdrawing through the needle passing hole 56 of cork removal portion 53. The cork 35 can then be pulled from needle 134 with minimal effort or may simply fall off when needle 134 is in the fully retracted position.

The invention facilitates opening of corked bottles using pressurized gas by reducing the physical efforts and dexterity required. Penetration of the needle of the cork extractor tool into the cork is made easier by the axial rotation of the needle as the cork is penetrated and withdrawal of an impaled cork from the needle also requires less physical force. The cork extractor tool aligns the needle with the neck of the bottle during penetration of the cork. Accidental contact of the sharp needle point with the user's hands is inhibited. The cork extractor tool can also include the cutting blades to facilitate cutting away of the top foil wrapping covering the cork at the neck of a bottle.

Many variations of the cork extractor are possible while staying within the same inventive concept. For example, while the container is shown as being a wine bottle, other types of corked bottles may be uncorked, with the positioning legs being modified to receive the particular bottle. Likewise, other valve designs are possible which permit the incremental controlled removal of pressurized fluid from the fluid container. Likewise, other types of replaceable and refillable pressurized containers are also contemplated within the scope of the present invention. Some such pressurized containers and devices which utilize them (particularly as relating to the connection and piercing of the end seal of the pressurized containers, and the valves used with the pressurized containers) are disclosed in U.S. Pat. No. 6,276,565 issued to Parsons et al. for a "Gas-Driven Liquid Dispenser Employing Separate Pressurized-Gas Source", U.S. Pat. No. 6,036,054 issued to Grill for an "Attachment Adapted For A Carbonated Liquid Container", U.S. Pat. No. 5,758,828 issued to Takahashi for a "Carbonated Shower Apparatus", U.S. Pat. No. 5,628,350 issued to Gibb for an "Inflating Device", U.S. Pat. No. 4,894,036 issued to Switlik for an "Inflator Assembly For Life Vests", and U.S. Pat. No. 4,526,730 issued to Cochoran et al. for a "Home Carbonating Apparatus" the complete disclosures of all of these patents being herein incorporated by reference.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A cork extractor tool for withdrawing a cork from the neck of a bottle, the cork extractor tool which utilizes a replaceable pressurized container having a generally cylindrical fluid container which contains a pressurized fluid having a boiling point below room temperature so as to expand upon depressurization, and a valve covering an opening in an end portion of the fluid container with an outlet tube which opens the valve when depressed to release pressurized fluid from the pressurized container through the outlet tube, the cork extractor tool comprising:

a tubular sleeve having an annular outer wall adapted to receive at least the end portion of the fluid container therewithin, and having a positioning portion extending from a bottom end of said tubular sleeve adapted for grasping in-hand and coaxially engaging the neck of the bottle above the cork, the pressurized container being longitudinally movable within said tubular sleeve to actuate the valve to release pressurized fluid therefrom;

a handle coaxially disposed about said tubular sleeve, said handle having a longitudinal bore that extends completely through said handle in which said tubular sleeve is closely slidably disposed;

a needle carrier slidably disposed within said tubular sleeve which is operatively connected to said handle for axial and rotational movement therewith within said tubular sleeve, said needle carrier having a longitudinal bore therethrough adapted to receive pressurized fluid from the outlet tube of the pressurized container;

a hollow needle extending axially from said needle carrier adapted for axial and rotational movement with said needle carrier and being of sufficient length to penetrate axially through the cork and having a longitudinal passage for transporting the pressurized fluid therethrough, said needle being operatively connected to the needle carrier to receive pressurized fluid therefrom and pass the pressurized fluid through into the bottle; and a rotation device operatively interconnecting said tubular sleeve and said handle, and being adapted to produce relative rotational motion therebetween upon axial translation thereof; and wherein when said positioning portion of said tubular sleeve coaxially engages the neck of the bottle above the cork and said handle is forced downwardly toward the cork, said needle is axially driven through the cork with an axial rotation to facilitate penetration, and when the pressurized container is subsequently depressed to inject the pressurized fluid into the bottle through said needle, with a resulting rise in pressure within the bottle as the pressurized fluid expands to a gas acting to eject the cork from the bottle.

2. The cork extractor tool according to of claim 1, wherein the positioning portion of the tubular sleeve includes a pair of tool positioning legs which extend downwardly from the bottom end of said tubular sleeve, each of said tool positioning legs including an elongate support bar affixed at respective upper ends to the bottom end of said tubular sleeve, and a lower end to which is affixed an arcuate bottle gripping member which extends radially inwardly from said lower end of each support bar and which is curved to fit against the bottle to jointly partially encircle the neck of the bottle, said tool positioning legs being disposed at radially opposite sides of the needle and being spaced apart by a distance sufficient to receive the neck of the bottle between said tool positioning legs.

3. The cork extractor tool of claim 2, wherein the tool positioning legs are made of a material having sufficient resiliency to enable flexing of said tool positioning legs inwardly towards the bottle by a user of the cork extractor tool to bring the bottle gripping portions into coaxial contact with the bottle, such that a user of the cork extractor tool may flex said tool positioning legs inwardly by squeezing them together with their hand that is also grasping and supporting the cork extractor tool.

4. The cork extractor tool of claim 3, wherein at least one of the bottle gripping portions has a cutting blade secured thereto which extends radially inwardly therefrom, such that the user of the cork extractor tool may flex said tool positioning legs inwardly by squeezing them together with their hand along with simultaneous rotation of the cork extractor tool relative to bottle makes a circular cut through a wrapping disposed around the neck of the bottle to enable removal of the wrapping to expose the cork for subsequent removal using the cork extractor tool.

5. The cork extractor tool according to claim 3, wherein the tool positioning legs each have a longitudinally concave inner surface facing the bottle during use to provide additional clearance therebetween.

6. The cork extractor tool according to claim 1, wherein the rotation device comprises at least one generally helical slot disposed through the outer wall of the tubular sleeve, and a guide disposed through said helical slot which interconnects the handle to the needle carrier for axial and rotational movement therewith within said tubular sleeve, said guide engaging said axial slot of said tubular sleeve to cause rotational movement of said needle carrier and handle relative to said tubular sleeve in response to axial movement therebetween as said guide follows said helical slot.

7. The cork extractor tool according to claim 6, wherein the tubular sleeve includes at least a pair of generally helical slots which are intertwined, each of said slots being operably associated with a respective guide.

8. The cork extractor tool according to claim 7, wherein the needle carrier is disposed in coaxial relationship with the handle and the tubular sleeve, said needle carrier being of such an outer diameter as to closely slidably fit within said tubular sleeve, said needle carrier being connected to the handle through said helical slots by the guides.

9. The cork extractor tool according to claim 7, wherein each guide comprises a pin member which extends through a radial hole in a lower portion of the handle, and through the helical slot of the tubular sleeve, being affixed to the needle carrier extending radially thereof.

10. The cork extractor tool according to claim 9, wherein each guide includes a tubular bushing and the pin member comprises a headed pin member, said bushing being disposed about said headed pin member, being retained by said headed pin member disposed through the helical slot of the tubular sleeve.

11. The cork extractor tool according to claim 10, wherein the headed pin member comprises a bolt which engages a mating threaded hole of the needle carrier.

12. The cork extractor tool according to claim 11, wherein the screws and bushings are disposed in respective clearance holes through the handle.

13. The cork extractor tool according to claim 12, wherein the handle includes a contoured outer surface having a plurality of longitudinal depressions to aid in gripping said handle in-hand.

14. The cork extractor tool according to claim 1, wherein the needle has a blunt upper portion with an inlet hole and a pointed lower portion with a transverse outlet hole, said upper portion of said needle being affixed within said longitudinal bore of the needle carrier.

15. The cork extractor tool according to claim 14, wherein the longitudinal bore through the needle carrier includes respective upper and lower portions which form an inwardly directed flange therebetween against which the blunt upper end portion of the needle abuts.

16. The cork extractor tool according to claim 14, wherein an annular groove is formed in the longitudinal bore of the needle carrier with an O-ring disposed in said annular groove to seal against the outlet tube of the pressurized container when inserted into the tubular sleeve.

17. The cork extractor tool according to claim 1, wherein the tubular sleeve includes a cork removal portion that covers the lower end of said tubular sleeve and adapted for abutment against the neck of bottle and the cork, said cork removal portion having a central hole disposed coaxial with said tubular sleeve and the handle, said central hole being of a smaller diameter than the cork and through which the needle extends and retracts, the cork impaled on said needle being stripped from said needle by axially moving apart said handle from said tubular sleeve following removal of the cork from the bottle, causing retraction of said needle through said central hole, wherein the cork can then be removed from said needle with minimal effort.

18. A cork extractor tool for withdrawing a cork from the neck of a bottle, comprising:

a replaceable pressurized container having a generally cylindrical fluid container which contains a pressurized fluid having a boiling point below room temperature so as to expand upon depressurization, and a valve covering an opening in an end portion of said fluid container with an outlet tube which opens said valve when depressed to release pressurized fluid from said pressurized container through said outlet tube;

a tubular sleeve having an annular outer wall adapted to receive at least said end portion of said fluid container therewithin, and having a positioning portion extending from a bottom end of said tubular sleeve adapted for grasping in-hand and coaxially engaging the neck of the bottle above the cork, said pressurized container being longitudinally movable within said tubular sleeve to actuate said valve to release pressurized fluid therefrom;

a handle coaxially disposed about said tubular sleeve, said handle having a longitudinal bore that extends completely through said handle in which said tubular sleeve is closely slidably disposed;

a needle carrier slidably disposed within said tubular sleeve which is operatively connected to said handle for axial and rotational movement therewith within said tubular sleeve, said needle carrier having a longitudinal bore therethrough adapted to receive pressurized fluid from said outlet tube of said pressurized container;

a hollow needle extending axially from said needle carrier adapted for axial and rotational movement with said needle carrier and being of sufficient length to penetrate axially through the cork and having a longitudinal passage for transporting the pressurized fluid therethrough, said needle being operatively connected to the needle carrier to receive pressurized fluid therefrom and pass said pressurized fluid through into the bottle; and a rotation device operatively interconnecting said tubular sleeve and said handle, and being adapted to produce relative rotational motion therebetween upon axial translation thereof; and wherein when said positioning portion of said tubular sleeve coaxially engages the neck of the bottle above the cork and said handle is forced downwardly toward the cork, said needle is axially driven through the cork with an axial rotation to facilitate penetration, and when said pressurized container is subsequently depressed to inject said pressurized fluid into the bottle through said needle, with a resulting rise in pressure within the bottle as said pressurized fluid expands to a gas acting to eject the cork from the bottle.

19. The cork extractor tool according to claim 18, wherein the pressurized fluid comprises compressed carbon dioxide gas.

20. The cork extractor tool according to claim 18, wherein the pressurized fluid comprises liquefied chlorofluorocarbon gas.

21. The cork extractor tool according to claim 18, wherein the valve comprises a metering valve which releases a fixed volume of pressurized fluid from the fluid container in response to each downward movement of said container regardless of the duration of the downward movement to avoid over-pressurization of the bottle and the undesirably rapid ejection of the cork.

22. The cork extractor tool according to claim 21, wherein the metering valve includes a generally cylindrical housing that is in coaxial relationship with the container and which has an upper fluid inlet, said housing having a flange an end portion of said pressurized fluid container surrounding said opening, an end cap being crimped around said flange and said opening to seal said opening and to secure said valve to said container, a tubular valve member slidably extends into said housing through said end cap, and through a resilient annular seal of said housing, said valve member having a flange that seats against said seal, and a compression spring disposed in said housing extends between said flange and housing to exert a downward force on said valve member, downward movement of said valve member in response to urging by said spring being limited by abutment of said end cap and said seal against said flange, wherein thumb pressure on the protruding upper end of said container forces said container including said end cap and said seal downwardly relative to said flange which movement momentarily opens said valve by exposing an inlet hole of said valve member inside of said housing thereby causing a release of a metered charge of pressurized fluid through said valve member and the needle into the bottle, discharge of fluid being limited to a fixed metered amount since the movement causes said valve member to seat against and close said inlet of said housing.

23. The cork extractor tool according to claim 18, wherein an upper end of the container protrudes upwardly beyond the handle to facilitate downward actuation of the container by hand.

24. A cork extractor tool for withdrawing a cork from the neck of a bottle, the cork extractor tool which utilizes a replaceable pressurized container having a generally cylindrical fluid container which contains a pressurized fluid having a boiling point below room temperature so as to expand upon depressurization, and an initially sealed opening in an end portion of the fluid container, the cork extractor tool comprising:

a valve operatively associated with the initially sealed opening and adapted to sealingly receive the end portion of the fluid container and open the initially sealed opening for fluid flow to said valve, said valve which opens when depressed to release pressurized fluid from the pressurized container;

a tubular sleeve having an annular outer wall adapted to receive at least said end portion of the fluid container therewithin, and having a positioning portion extending from a bottom end of said tubular sleeve adapted for grasping in-hand and coaxially engaging the neck of the bottle above the cork, the pressurized container being longitudinally movable within said tubular sleeve to actuate said valve to release pressurized fluid therefrom;

a handle coaxially disposed about said tubular sleeve, said handle having a longitudinal bore that extends completely through said handle in which said tubular sleeve is closely slidably disposed;

a needle carrier slidably disposed within said tubular sleeve which is operatively connected to said handle for axial and rotational movement therewith within said tubular sleeve, said needle carrier having a longitudinal bore therethrough adapted to receive pressurized fluid from said valve;

a hollow needle extending axially from said needle carrier adapted for axial and rotational movement with said needle carrier and being of sufficient length to penetrate axially through the cork and having a longitudinal passage for transporting the pressurized fluid therethrough, said needle being operatively connected to the needle carrier to receive pressurized fluid therefrom and pass said pressurized fluid through into the bottle; and a rotation device operatively interconnecting said tubular sleeve and said handle, and being adapted to produce relative rotational motion therebetween upon axial translation thereof; and wherein when said positioning portion of said tubular sleeve coaxially engages the neck of the bottle above the cork and said handle is forced downwardly toward the cork, said needle is axially driven through the cork with an axial rotation to facilitate penetration, and when said pressurized container is subsequently depressed to inject said pressurized fluid into the bottle through said needle, with a resulting rise in pressure within the bottle as said pressurized fluid expands to a gas acting to eject the cork from the bottle.

25. A cork extractor tool for withdrawing a cork from the neck of a bottle, comprising:

a replaceable pressurized container having a generally cylindrical fluid container which contains a pressurized fluid having a boiling point below room temperature so as to expand upon depressurization, and an initially sealed opening in an end portion of said fluid container;

a valve operatively associated with the initially sealed opening and adapted to sealingly receive said end portion of said fluid container and open said initially sealed opening for fluid flow to said valve, said valve which opens when depressed to release pressurized fluid from said pressurized container;

a valve operatively associated with said opening which opens when depressed to release pressurized fluid from said pressurized container;

a tubular sleeve having an annular outer wall adapted to receive at least said end portion of said fluid container therewithin, and having a positioning portion extending from a bottom end of said tubular sleeve adapted for grasping in-hand and coaxially engaging the neck of the bottle above the cork, said pressurized container being longitudinally movable within said tubular sleeve to actuate said valve to release pressurized fluid therefrom;

a handle coaxially disposed about said tubular sleeve, said handle having a longitudinal bore that extends completely through said handle in which said tubular sleeve is closely slidably disposed;

a needle carrier slidably disposed within said tubular sleeve which is operatively connected to said handle for axial and rotational movement therewith within said tubular sleeve, said needle carrier having a longitudinal bore therethrough adapted to receive pressurized fluid from said valve;

a hollow needle extending axially from said needle carrier adapted for axial and rotational movement with said needle carrier and being of sufficient length to penetrate axially through the cork and having a longitudinal passage for transporting the pressurized fluid therethrough, said needle being operatively connected to the needle carrier to receive pressurized fluid therefrom and pass said pressurized fluid through into the bottle; and a rotation device operatively interconnecting said tubular sleeve and said handle, and being adapted to produce relative rotational motion therebetween upon axial translation thereof; and wherein when said positioning portion of said tubular sleeve coaxially engages the neck of the bottle above the cork and said handle is forced downwardly toward the cork, said needle is axially driven through the cork with an axial rotation to facilitate penetration, and when said pressurized container is subsequently depressed to inject said pressurized fluid into the bottle through said needle, with a resulting rise in pressure within the bottle as said pressurized fluid expands to a gas acting to eject the cork from the bottle.

* * * * *